US005232337A

United States Patent [19]

Glynn

[11] Patent Number: 5,232,337

[45] Date of Patent: Aug. 3, 1993

[54] SLIP JOINT FOR MAINTAINING CONCENTRICITY

[75] Inventor: Christopher C. Glynn, Hamilton, Ohio

[73] Assignee: General Electric Company, Cincinnati, Ohio

[21] Appl. No.: 785,369

[22] Filed: Oct. 30, 1991

[51] Int. Cl.[5] ..... F01D 25/26

[52] U.S. Cl. ..... 415/134; 415/124.1; 416/198 A; 403/326

[58] Field of Search ..... 415/124.1, 124.2, 122.1, 415/229, 134, 136; 416/198 R, 198 A; 403/326, 288

[56] References Cited

U.S. PATENT DOCUMENTS

| | | | |
|---|---|---|---|
| 1,107,238 | 8/1914 | Kieser | 416/198 A |
| 3,011,794 | 12/1961 | Vaughn | 403/326 |
| 3,121,583 | 2/1964 | Damm | 403/326 |
| 3,339,832 | 9/1967 | Duecker | 415/134 |
| 3,706,509 | 12/1972 | Britt | 416/198 A |
| 4,078,812 | 3/1978 | Beckershoff | 403/288 |
| 4,201,426 | 5/1980 | Garten et al. | 415/229 |
| 4,424,004 | 1/1984 | Hiskes | 416/198 A |
| 4,623,297 | 11/1986 | Beam, Jr. | 415/122.1 |
| 4,687,412 | 8/1987 | Chamberlain | 415/134 |

*Primary Examiner*—Edward K. Look
*Assistant Examiner*—Mark Sgantzos
*Attorney, Agent, or Firm*—Jerome C. Squillaro

[57] ABSTRACT

A slip joint connects coaxially oriented tubular members in a manner to allow axial slippage while maintaining concentricity without generating large axial loads. The joint comprises a first tubular member having a smaller outside diameter than an inside diameter of a second member whereby the first member is slidable into the second member. A pair of spaced lands circumscribe the first member and define a groove therebetween. The slip joint has a seal ring position in the groove. The lands have a plurality of circumferentially spaced nodes extending radially outward so as to contact the inner diameter of the second member.

7 Claims, 1 Drawing Sheet

SLIP JOINT FOR MAINTAINING CONCENTRICITY

The present invention relates in general to gas turbine engines and, more particularly, to slip joints for use in joining tubular rotors of such engines.

BACKGROUND OF THE INVENTION

Gas turbine engines have been utilized to power a wide variety of vehicles and have found particular application in aircraft. The operation of a gas turbine engine can be summarized in a three step process in which air is compressed in a rotating compressor, heated in a combustion chamber, and expanded through a turbine. The power output of the turbine is utilized to drive the compressor any mechanical load connected to the drive. In general, the construction of these aircraft gas turbine engines involves an axial flow compressor and an axial flow turbine. The turbine is normally divided into a plurality of stages such as, for example, three, and the compressor may be similarly divided into a plurality of stages. Each of the turbine stages is typically coupled to drive a corresponding compressor stage. For example, a high pressure turbine stage is normally coupled in driving relationship to the high pressure compressor stage. In order to achieve this driving function, the turbine stage is coupled through the center portion of the engine to the various compressor stages. Typically, the coupling mechanisms are separate coaxial tubular drive shafts. In other instances, tubular shafts are connected to rotating bores of a turbine disk and interface with mating tubular shafts extending from a bore of a compressor disk in order to define areas of different temperature variations. These latter tubular shafts may be utilized to isolate an area of relatively hot, high pressure gases from relatively cool, lower pressure gases used for downstream cooling air. Since the axial flow of the turbine is generally an annular configuration, tubular joints are necessary to accommodate differential thermal growth over the extent of some tubes.

At each junction in which one tubular shaft interfaces with another tubular shaft, it is known to provide some kind of sealing arrangement between the two shafts. Typically, one of the shafts fits within the other of the shafts and a sealing device such as a piston ring is held in place between the two shafts. This allows relative rotation of one cylinder with respect to the other and at the same time allows axial slippage of the joint. It has been found, however, that in many instances, distortion of the shafts at the joint between the two shafts causes binding such that any differential axial growth may exert axial force on the disks to which the shafts are attached. A substantial axial force may result in interference and possible damage to rotating engine components. Furthermore, such axial growth may result in bending at the slip joint and consequent loss of the seal between the different pressure areas.

SUMMARY OF THE INVENTION

It is an object of the present invention to provide a method and apparatus for establishing a slip joint between two relative rotating cylinders which can accommodate axial motion without losing concentricity.

In one form, the invention is described as a slip joint for use in a gas turbine engine for connecting two coaxially rotating tubular shafts in which each of the shafts is subjected to radial deflection independent of the other of the shafts. One of the shafts is at least partially inserted within a second of the shafts. The slip joint comprises first and second generally parallel, raised lands circumscribing an outer surface of the first of the shafts and defining a circumferential groove for receiving an expandable sealing ring. At least one of the lands has a plurality of circumferentially spaced nodes extending above the outer surface of the first of the shafts and generally into sliding contact with an inner surface of the second of the shafts. The nodes maintain concentricity between the shafts while allowing the shaft to distort without creating any significant binding between the shafts. The sealing ring has its radially outer surface in contact with the inner surface of the outer shaft and one of the axial surfaces of the sealing ring in contact with an axial surface of the lands defining the groove. The sealing ring is free to follow surface distortions within a limited range to as to maintain seal integrity.

BRIEF DESCRIPTION OF THE DRAWINGS

For a better understanding of the present invention, reference may be had to the following detailed description taken in conjunction with the accompanying drawings in which.

DETAILED DESCRIPTION OF THE INVENTION

Figure 1:
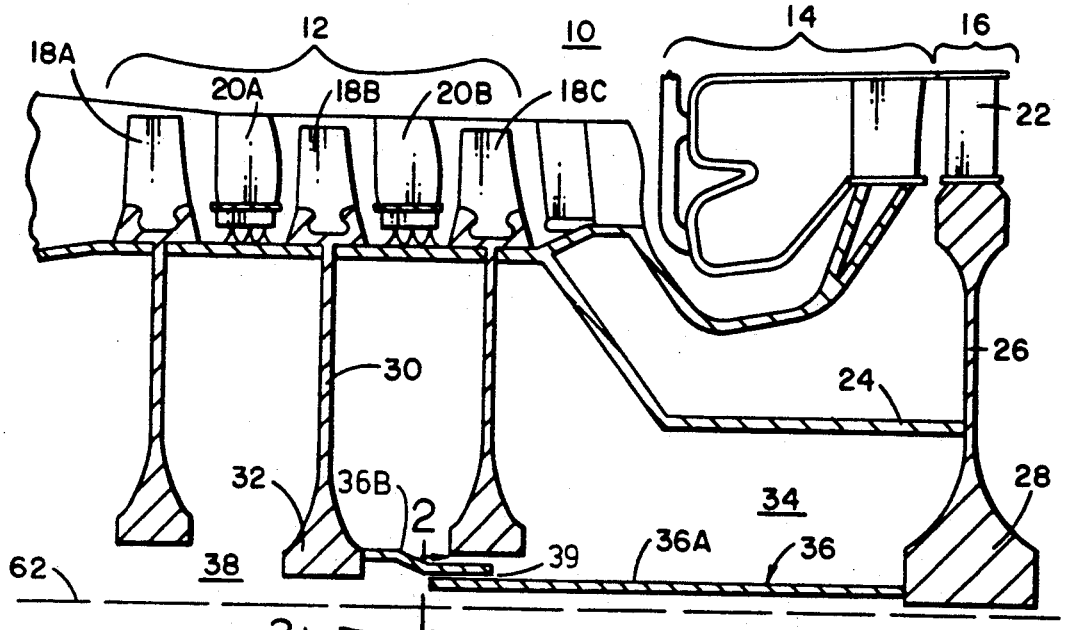
FIG. 1 is a simplified, partial cross-sectional view of a gas turbine engine with which the present invention may be used.

Referring to FIG. 1, there is shown a simplified, partial cross-sectional view of a gas turbine engine 10 with which the present invention may be used. The engine 10 includes a compressor section 12, a combustor section 14, and a turbine section 16. The compressor section 12 typically includes a plurality of stages, e.g., high pressure, intermediate pressure, and low pressure stages. It is common for the turbine section 16 to also include a plurality of stages such as a high, an intermediate, and a low pressure stage. FIG. 1 illustrates only a high pressure compressor stage, comprising rotating blades 18A, 18B, and 18C and stationary vanes 20A and 20B, connected to be driven by high pressure turbine blade 22 via annular shaft 24. Other compressor stages (not shown) are similarly connected to other turbine stages (not shown) via other coaxial shafts (not shown).

Each of the rotating blades in the compressor section and turbine section extend from a rim of a rotating disk. Blade 22 extends from a disk comprising web portion 26 and a bore portion 28. Blade 18B extends from a rim of a disk comprising web portion 30 and bore portion 32. Within the area circumscribed by the annular shaft 24, there is defined a cavity 34 in which high pressure, relatively hot air has leaked from the aft portion of the high pressure compressor stage. While it is desirable for this air to exist in cavity 34 to assist in cooling adjacent components which are subjected to the higher temperature environment of combustor section 14, it is not desirable for this air to leak into other areas in which cooler air is present. For this reason, an air tube or duct 36 is positioned within shaft 24 extending from the bore 28 to the bore 32. The tube 36 isolates the cavity 34 from an inner cavity 38 in which the lower pressure and cooler air is located. The air in cavity 38 is typically used to cool bearings and other areas downstream of the combustor.

Since the disk associated with turbine blades 22 is subjected to much higher temperature than are found in the compressor section, there is a difference in thermal growth between the turbine and compressor which must be accommodated by the tube 36. One method for accommodating such differential thermal growth is to form the tube 36 in two concentric sections 36A and 36B with preselected overlapping portions sufficient to allow differential axial growth without separation. The slip joint 39 thus formed between the tube sections 36A and 36B has to support the end of the tube sections, provide for axial slippage to avoid axial displacement of blades 18B, 22, and to maintain a seal to prevent leakage of the higher temperature air into 38.

Figure 2:
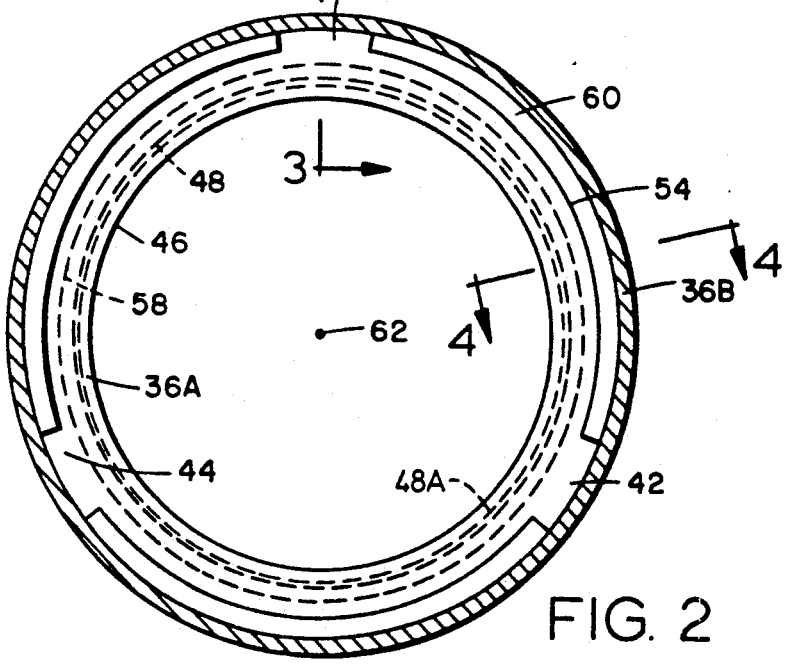
FIG. 2 is a cross-sectional view taken normal to the axis of a pair of concentric shafts assembled in accordance with the present invention.
Figure 3:
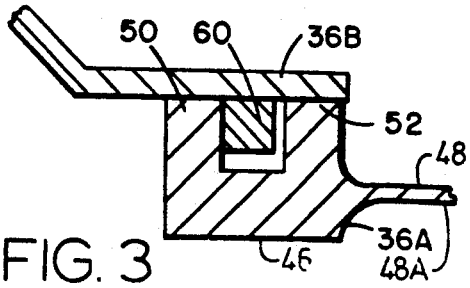
FIG. 3 is a cross-sectional view taken along the lines 2—2 of FIG. 1.

Turning now to FIGS. 2 and 3, there is shown an axial view in FIG. 2 of the pair of shafts 36A and 36B at slip joint 39 in which the shaft 36A fits slidingly within the shaft 36B and in which the present invention is incorporated. The shaft 36A is formed with three nodes 40, 42, and 44 circumferentially spaced about the outer surface of the shaft and sized so that the nodes are in general contact with an inner surface of the outer shaft 36B. The inner shaft 36A is defined by inner surfaces 46, 48A and an outer surface indicated by the dashed line 48. A pair of spaced lands 50, 52, shown in FIGS. 3 and 4, taken respectively, along lines 3—3 and 4—4 of FIG. 2, circumscribe the outer surface 48 adjacent an end of the inner shaft 36A. A radially outer surface of the lands is indicated at 54 and a bottom of a groove 56 defined between the lands 50, 52 indicated at 58.

Figure 4:
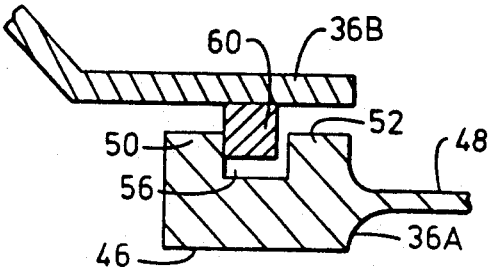
FIG. 4 is a cross-sectional view taken along line 4—4 of FIG. 2.

Referring to FIGS. 3 and 4 in conjunction with FIG. 2, it can be seen that the pair of lands 50, 52 establish the groove 56 in which a split piston ring or other expansible sealing ring 60 can be inserted. A radially outer surface of the ring 60 abuts the inner surface of the outer shaft 36B and one of the axial sides of the ring 60 abuts one of the axial sides of the two lands 50, 52 defining the groove 56.

It can be seen that if a radial load is applied to the inner shaft 36A or the outer shaft 36B, either shaft can rotate or pivot normal to the axis 62 without deflecting the sides of the other shaft. The circumferentially spaced nodes or loading pads allow the end of one or both of the cylinders to bend out of round and create small radial interference loads while maintaining concentricity. So long as this concentricity is maintained, easy axial slippage and functioning of the sealing device will occur.

The foregoing detailed description of the preferred embodiment of the present invention is intended to be illustrative and non-limiting. Many changes and modifications are possible in light of the above teachings. Thus, it is understood that the invention may be practiced otherwise than is specifically described herein and still be within the spirit and scope of the appended claims.

What is claimed is:

1. A slip joint for use in a gas turbine engine for connecting coaxially rotating tubular rotors in which each of the rotors is subjected to radial deflection independent of the other of the rotors, a first of the rotors being at least partially inserted within a second of the rotors, the slip joint comprising:

a first and a second generally parallel raised lands circumscribing an outer surface of the first of the rotors and defining a circumferential groove therebetween, at least one of the lands having a plurality of circumferentially spaced nodes extending above the outer surface of the first of the rotors and generally into sliding contact with an inner surface of the second of the rotors for maintaining concentricity between the rotors; and an expandable sealing ring positioned in said groove, a radially outer surface of said ring contacting the inner surface of the second of the rotors and at least one axial side of one of said lands for preventing fluid flow through the slip joint between the rotors.

2. The slip joint of claim 1 wherein said sealing ring comprises a split piston ring.

3. The slip joint of claim 1 wherein said plurality of nodes comprises three nodes.

4. The slip joint of claim 3 wherein each of said lands includes coextensive ones of said nodes.

5. A slip joint for connecting coaxially oriented tubular members in a manner to allow axial slippage while maintaining concentricity without generating large axial loads, the joint comprising a first tubular member having a smaller outside diameter than an inside diameter of said second member whereby said first member is slidable into said second member, and a pair of spaced lands circumscribing said first member and defining a groove therebetween, said lands having a plurality of circumferentially spaced nodes extending radially outward so as to contact the inner diameter of said second member.

6. The slip joint of claim 5 and including a seal ring positioned in said groove.

7. A slip joint for maintaining concentricity between first and second tubular shafts, the first shaft having an outer diameter which is less than the inner diameter of the second shaft at the joint, the first shaft having a plurality of circumferentially spaced nodes extending from an outer surface and into contact with an inner surface of said second shaft when said shafts are in an assembled position, each of said nodes having a common height above the surface of said first shaft for establishing a coaxial orientation of said shafts, said nodes supporting said first shaft within said second shaft to maintain concentricity between said shafts and permitting distortion of said shafts at the joint without interfering with axial slippage of said first shaft with respect to said second shaft.

* * * * *